United States Patent [19]

Vuachet et al.

[11] Patent Number: 5,069,976

[45] Date of Patent: Dec. 3, 1991

[54] SNOW SKI SOLES

[75] Inventors: Michel Vuachet, Bron; Jean-Marie Huet, St. Etienne du Vauvray, both of France

[73] Assignee: Atochem, Puteaux, France

[21] Appl. No.: 308,019

[22] Filed: Feb. 9, 1989

[30] Foreign Application Priority Data

Feb. 9, 1988 [FR] France ..... 88 01519

[51] Int. Cl.[5] ..... B32B 27/08; A63C 5/00

[52] U.S. Cl. ..... 428/474.4; 280/610; 280/18; 280/15

[58] Field of Search ..... 428/474.4; 525/167, 525/408

[56] References Cited

U.S. PATENT DOCUMENTS

| | | | |
|---|---|---|---|
| 4,397,991 | 8/1983 | Drawert et al. | 525/167 |
| 4,635,954 | 1/1987 | Arnsteiner | 280/601 |

FOREIGN PATENT DOCUMENTS

| | | | |
|---|---|---|---|
| 1811071 | 9/1969 | Fed. Rep. of Germany . | |
| 2564737 | 11/1985 | France . | |
| 2592388 | 7/1987 | France | 525/167 |
| 8125735 | 7/1983 | Japan | 525/167 |
| 71348 | 4/1984 | Japan | 525/167 |
| 2218433 | 9/1987 | Japan | 525/167 |
| 2112789 | 7/1983 | United Kingdom | 525/167 |

*Primary Examiner*—Edith L. Buffalow

*Attorney, Agent, or Firm*—Burnes, Doane, Swecker & Mathis

[57] ABSTRACT

Improved snow ski and other soles (bases), having enhanced and durable wax absorption, are fabricated from a sheet or film of a thermoplastic polymeric material based on an intimate admixture of one or more polyolefins, e.g., high density polyethylene, and one or more polyetheresteramides.

23 Claims, No Drawings

SNOW SKI SOLES

BACKGROUND OF THE INVENTION

1. Field of the Invention

The present invention relates to a ski base, or sole, namely, the bottom part of the ski in contact with the snow and upon which the ski and the skier are supported.

The invention especially relates to an improved snow ski sole having excellent capability of absorbing waxes and durably retaining such waxes.

2. Description of the Prior Art

Ski soles generally are in the form of a sheet or a film having a thickness in the range 0.5 to 2 mm. They are made of polyolefinic plastic material and are preferably based on high density polyethylene (HDPE), which may optionally be of high molecular weight (number average molecular weight in the range of 150,000 to 450,000) which can be measured by gel permeation chromatography.

Soles of this type are produced by conventional extrusion techniques. Nonetheless, their properties of impact resistance, dye affinity and the capability of absorbing waxes (fat-like substances of the paraffinic type) are not very satisfactory, or they are even inadequate for the specific requirements of a ski sole.

Attempts have been made to improve the specific properties and qualities of the polyethylenes used for ski soles by modifying their structure, either by incorporating additives or by treatment with an agent promoting the porosity of HDPE.

Thus, U.S. Pat. No. 3,075,948 describes grafting of a polyolefin (and particularly a polyethylene) with a silane.

In the French Patent published under No. 2,478,877, it was proposed to modify the sliding surface by incorporating a substance which is soluble in non-aqueous liquids into the HDPE before extrusion, then converting it into sheet or film.

Very high molecular weight HDPE (number average molecular weight in the range of 300,000 to 8,000,000) is also used for making ski soles designed for world class competition. These soles are produced by sintering, a much more difficult technique than extrusion.

In Austrian Patent No. 332,273, a process is described for producing a ski sole made from sintered HDPE.

SUMMARY OF THE INVENTION

Accordingly, a major object of the present invention is the provision of an improved snow ski sole which comprises a sheet or a film of a thermoplastic polymeric material based on an intimate admixture of one or more polyolefins and one or more polyetheresteramides.

The ski soles of this invention have such improved properties as, in particular:

(i) Excellent capability for absorbing waxes and retaining them in a durable manner;

(ii) A very fine sliding action, due to a low coefficient of friction;

(iii) Good resistance to impacts and abrasion;

(iv) Good suitability for being glued to the ski blade;

(v) A particularly good affinity for dyes, as well as antistatic characteristics at low temperatures; and (vi) A transparency or translucency such that the blade of the ski can be seen quite clearly through the sole, the blade optionally bearing various inscriptions such as designs, trademarks and the like.

DETAILED DESCRIPTION OF THE PREFERRED EMBODIMENTS OF THE INVENTION

More particularly according to the present invention, as described above, the subject ski soles comprise a thermoplastic polymeric material based on one or more polyolefins and one or more polyetheresteramides, and may contain various additives, fillers and the usual adjuvants.

By the term "polyetheresteramides" are intended not only random polyetheresteramides (those formed by random chain formation from the various monomeric constituents) but also block polyetheresteramides (those formed in blocks of their various constituents having certain chain lengths).

Polyetheresteramides are products of the condensation copolymerization of polyamide sequences having reactive ends with polyether sequences having reactive ends, such as, inter alia, polyamide sequences having dicarboxyl chain ends with polyetherdiol sequences.

Polymers of this type are described, for example, in French Patents Nos. 74/18,913 and 77/26,678, and in U.S. Pat. Nos. 4,331,786 and 4,332,920, hereby incorporated by reference.

The number average molecular weight of these polyamide sequences is generally in the range of 500 to 10,000 and more particularly in the range of 600 to 5,000. The polyamide sequences of the polyetheresteramides are preferably formed from polyamide 6, 6.6, 6.12, 11 or 12 (PA-6, PA-6.6, PA-6.12, PA-11, PA-12) or from amide copolymers resulting from the condensation polymerization of the monomers thereof.

The number average molecular weight of the polyethers is generally in the range of 200 to 6,000 and more particularly in the range of 600 to 3,000.

The polyether sequences preferably comprise polytetramethylene glycol (PTMG), polypropylene glycol (PPG), or polyethylene glycol (PEG).

The intrinsic viscosity of the polyetheresteramides is advantageously in the range of 0.8 to 2.05.

The intrinsic viscosity is measured in metacresol at 20° C. at an initial concentration of 0.5 g per 100 g of metacresol. It is expressed in $dlg^{-1}$.

The polyetheresteramides according to the invention may be formed from 5 to 85% by weight of polyether, and from 95 to 15% by weight of polyamide, and preferably from 30 to 80% by weight of polyether and 70 to 20% by weight of polyamide.

The polyolefin or polyolefins used for the ski soles of the present invention comprise(s) polypropylene (PP), polyethylene (PE), mixtures or copolymers of these, but preferably polyethylene.

In a preferred embodiment of the invention, the polyolefin or polyolefins are of high molecular weight.

The number average molecular weight of the preferred polyolefins may be in the range of 100,000 to 500,000 and preferably in the range of 150,000 to 400,000.

The mixture of the thermoplastic polymeric material forming the ski sole of the invention may contain from 50 to 99% by weight of polyolefin or polyolefins and from 50 to 1% by weight of polyetheresteramide or polyetheresteramides. Preferably it contains from 60 to 90% by weight of polyolefin(s) and from 40 to 10% of polyetheresteramide(s).

The mixture may optionally contain, for example, up to 70% of organic or inorganic fillers, which may be in the form of fibers or powders.

Similar mixtures have been described in the French Patent published under No. 2,519,012.

Exemplary of such fillers are silica, titanium dioxide, glass fibers and carbon fibers.

The mixture may also contain various additives such as UV stabilizers, release agents, impact modifiers, waxes, and the like.

An emulsifier may additionally be incorporated to improve the compatibility of the different constituents of the mixture.

Maleinated polypropylene may, for example, be selected as the emulsifier.

In general, from 1 to 5% by weight of emulsifier is incorporated into the mixture.

The emulsifier does not need to be present. However, it is particularly recommended when the proportion of polyetheresteramide in the mixture is greater than or equal to 20% by weight.

The production of ski soles according to the invention and particularly the forming of sheet or film made from the mixture described above may be carried out according to any known extrusion process. Before the mixture is actually extruded, it is additionally necessary to form an intimate mixture of the said components of the sole.

It is possible to conduct this operation by forming a mechanical mixture of the components of the sole prior to being introduced into the hopper of the extruder.

It is also possible to mix the raw materials forming the intimate mixture previously described in the form of powders or granules and subsequently to process the mixture in the molten state in a single screw or twin screw extruder, or in kneading equipment or in calendering equipment. This technique ensures a better homogeneity of the mixture.

Once the components of the sole are intimately mixed, it is possible to proceed with the actual extrusion. Any type of single screw or twin screw extruder may be used.

The preferred extrusion techniques are extrusion-coating, or extrusion-horizontal calendering.

A sheet or a film of the mixture previously described is thus obtained having a thickness in the range of 0.5 to 2 mm and preferably in the range of 0.9 to 1.4 mm.

An alternative embodiment of the process for production of a ski sole according to the invention comprises incorporating the whole or part of the waxes into the mixture forming the sole before extrusion. A sole is thus obtained which is to a greater or lesser extent self-waxing, meaning that the waxing of the ski provided with this sole will no longer be necessary.

The self-waxing technique has the following advantages:

(a) The sole can absorb a greater amount of waxes;

(b) The waxes, being incorporated in the structure of the sole, are permanently maintained in this structure and the ski is thus internally waxed once and for all.

By the term "waxes" are intended both slip waxes, used more particularly for alpine skis and grip waxes, used more particularly for cross-country skis.

The main function of the so-called slip waxes is generally to improve the sliding of the ski on the snow by reducing the coefficient of friction of the said sole by a not inconsiderable amount.

The so-called grip waxes mainly have a function of preventing the ski from sliding backwards: the snow crystals can penetrate the surface layer of wax and thus they impart to the sole the anchoring characteristics necessary for giving the ski a good grip on the snow, preventing it from sliding in a different direction from that desired by the skier.

The gluing of the sole to the ski blade can be carried out by a conventional process. By way of example, the operation may be carried out by hot adhesion: the film or sheet is heated and laminated onto the ski blade under pressure.

The present invention is equally applicable for producing and using a sheet or a film based on one or more polyetheresteramides and one or more polyolefins of the type previously described as a sliding surface for objects whose function is to slide on a liquid or solid surface, such as water, snow, grass, etc.

Exemplary of recreational equipment having such surface are toboggans, sledges, sleds, sailboards and surfboards.

In order to further illustrate the present invention and the advantages thereof, the following specific examples are given, it being understood that same are intended only as illustrative and in nowise limitative.

EXAMPLE 1

(A) COMPONENTS

The composition of the ski sole comprised, by weight:

| | |
|---|---|
| (i) high density polyethylene (HDPE) (ethylene-butene copolymer containing 2 to 3% butene, for which $\overline{Mn}$ = 150,000) | 90 parts |
| (ii) polyetheresteramide (resulting from the condensation copolymerization of PA-12 sequences having $\overline{Mn}$ = 600 and polyether (PTMG) sequences having $\overline{Mn}$ = 2,000). | 10 parts |

(B) APPLICATION

The process was carried out up to the mechanical mixture of granules of the components described in 1.A. The mixture thus obtained was subsequently fed into a single screw extruder, the rotational speed of the screw of which was 100 r.p.m. Within the extruder, the entire mass was brought to a temperature in the range of 225° to 230° C.

A continuous sheet was obtained from the die orifice, having a thickness of 1.2 mm and a width of 105 mm (SAMPLE 1).

For comparison, HDPE alone was extruded under the same conditions as above such as to obtain a continuous sheet of thickness 1.2 mm and width 105 mm (SAMPLE 2).

In order to determine the characteristics of the sheets from SAMPLES 1 and 2, the surface free energy $\gamma_s$ of the surfaces of the sheets from SAMPLES 1 and 2 was determined, as well as its two components: $\gamma_s^d$ and $\gamma_s^p$.

The surface free energy of the surface of a solid is the sum of the component $\gamma_s^d$ (contribution of the London dispersive forces) and the component $\gamma_s^p$ (contribution of the non-dispersive forces: polar forces and other forces) $\gamma_s=\gamma_s^d+\gamma_s^p$.

In order to determine same, the angle of contact $\theta$ made by a drop of standard liquid deposited on a horizontally maintained face of the sheets of SAMPLES 1 and 2 was measured.

The method for measuring the angle of contact is explained in the article by W. D. Warkins, *The Physical Chemistry of Surface Films*, p. 41. Reinhold Pub. Corp. (1952).

The measurements of angles of contact were carried out at 25° C. on the two faces of the samples successively.

The standard liquids used were:

(i) diiodomethane, α-bromonaphthalene (liquids having low polarity);

(ii) water, formamide (polar liquids).

A drop of from 1 to 5 μl of standard liquid was deposited on the horizontally maintained face of the sheet.

30 seconds to 2 minutes after the drop had been deposited on the horizontal surface of the sheet, the angle of contact $\theta$ made by the drop with the horizontal surface upon which it had been deposited was measured.

Having measured the angle of contact, the method of W. Rabel, *Farbe and Lack*, 77 Jahrg, No. 10, 997–1006 (1971) was used to calculate $\gamma_s^d$, $\gamma_s^p$ and $\gamma_s$.

The results are reported in Table 1.

$\gamma_s^d$, $\gamma_s^p$ and $\gamma_s$ are expressed in nM.m$^{-1}$. The accuracy of the measurements was to ±1 mN.m$^{-1}$.

No significant difference was observed between the two faces of SAMPLES 1 and 2.

The physical characteristics of SAMPLES 1 and 2 were very different: SAMPLE 1 (mixture of HDPE and polyether ester amide) had a surface free energy 39% greater than that of SAMPLE 2 (HDPE alone). The polar contribution was equal to 6.7 mN.m$^{-1}$. for SAMPLE 1 while it was zero for SAMPLE 2.

TABLE 1

| | Surface free energy $\gamma S$ (mN · M$^{-1}$) | Dispersive contribution $\gamma S^d$ (mN · m$^{-1}$) | Polar contribution $\gamma S^p$ (mN · m$^{-1}$) |
|---|---|---|---|
| SAMPLE 1 | 45.4 | 38.7 | 6.7 |
| SAMPLE 2 | 32.7 | 32.7 | 0 |

EXAMPLE 2

(A) COMPONENTS

The compositions of the sole comprised, by weight:

| | |
|---|---|
| (i) HDPE (propylene homopolymer having $\overline{Mn}$ = 300,000) | 80 parts |
| (ii) polyetheresteramide (obtained by condensation copolymerization of PA-12 sequences having $\overline{Mn}$ = 850 and polyether (PTMG) sequences having $\overline{Mn}$ = 2,000). | 20 parts |

(B) APPLICATION

The composition described in A was mixed in the molten state in a twin screw WERNER PFLEIDERER extruder of the type ZSK 30.

The entire mass was brought to 230°, the rotational speed of the screw was 150 r.p.m. and the output of material was 17 kg/h.

Granules were obtained which were extruded under conditions identical with those in EXAMPLE 1 such as to obtain a continuous sheet of 1.2 mm thickness and 105 mm width.

As a comparison, HDPE alone was extruded (the characteristics of which were those described in 2.A) under the same conditions such as to obtain a continuous HDPE sheet of 1.2 mm thickness and 105 mm width.

The sheets made in this manner were suitable for being glued to a ski blade and the ski thus made can be subjected to a waxing process.

EXAMPLE 3

A few parts by weight of a commercially available wax were added to the mixture of HDPE and polyetheresteramide produced in the molten state and described in EXAMPLE 2. This mixture thus obtained was extruded under the same conditions as in 2.B.

A so-called "self-waxing" continuous sheet was obtained which could be glued to a ski blade.

Depending on the quantity of wax introduced as above in the structure of the sole, a subsequent waxing may not be necessary.

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims, including equivalents thereof.

What is claimed is:

1. A ski sole comprising a sheet or a film of a thermoplastic polymeric material in the form of a ski sole, said thermoplastic polymeric material comprising an intimate admixture of one or more polyolefins and one or more polyetheresteramides.

2. The ski sole as defined by claim 1, said polyetheresteramide or polyetheresteramides comprising random polyetheresteramides.

3. The ski sole as defined by claim 1, said polyetheresteramide or polyetheresteramides comprising the condensation copolymerizates of polyamide sequences having reactive end groups with polyether sequences having reactive end groups.

4. The ski sole as defined by claim 3, said polyamide sequences having reactive carboxyl end groups and said polyether sequences having reactive hydroxyl end groups.

5. The ski sole as defined by claim 3, said polyamide sequences comprising polyamide 6, 11, 66, 612 or 12, or copolyamide thereof.

6. The ski sole as defined by claim 3, wherein the number average molecular weight of said polyamide sequences ranges from 500 to 10,000.

7. The ski sole as defined by claim 3, said polyether sequences comprising polytetramethylene glycol (PTMG), polypropylene glycol (PPG) or polyethylene glycol (PEG).

8. The ski role as defined by claim 3, wherein the number average molecular weight of said polyether sequences ranges from 200 to 6,000.

9. The ski sole as defined by claim 3, said polyetheresteramide comprising from 5 to 85% of polyether and from 95 to 15% of polyamide.

10. The ski sole as defined by claim 1, said polyolefin or polyolefins comprising polypropylene, polyethylene, or mixture or copolymer thereof.

11. The ski sole as defined by claim 10, said polyolefin comprising a high density polyethylene having a number average molecular weight in the range of 100,000 to 500,000.

12. The ski sole as defined by claim 1, said intimate admixture comprising 50 to 99% by weight of polyolefin or polyolefins and from 50 to 1% by weight of polyetheresteramide or polyetheresteramides.

13. The ski sole as defined by claim 12, said intimate admixture comprising from 60 to 90% by weight of polyolefin and from 40 to 10% by weight of polyetheresteramide.

14. The ski sole as defined by claim 1, further comprising organic or inorganic filler material.

15. The ski sole as defined by claim 1, further comprising a UV stabilizer, release agent or emulsifier.

16. The ski sole as defined by claim 1, said intimate admixture further comprising a wax.

17. The ski sole as defined by claim 6, said number average molecular weight ranging from 600 to 5,000.

18. The ski sole as defined by claim 8, said number average molecular weight ranging from 600 to 3,000.

19. The ski sole as defined by claim 9, said polyetheresteramide comprising from 30 to 80% of polyether and from 70 to 20% of polyamide.

20. The ski sole as defined by claim 11, said number average molecular weight ranging from 150,000 to 400,000.

21. In a snow ski comprising a blade and a sole member bonded thereto, the improvement which comprises, as the sole member therefor, the ski sole as defined by claim 1.

22. An article including a base element adapted for sliding engagement along a liquid or solid surface, said base element comprising a sheet or film of a thermoplastic polymeric material, said thermoplastic polymeric material comprising an intimate admixture of one or more polyolefins and one or more polyetheresteramides.

23. The article as defined by claim 22, comprising a toboggan, sledge, sled, sailboard or surfboard.

* * * * *